US008875921B2

(12) United States Patent
Hermel et al.

(10) Patent No.: US 8,875,921 B2
(45) Date of Patent: Nov. 4, 2014

(54) LIGHTWEIGHT CONTAINER HAVING A REINFORCED BASE

(75) Inventors: Wilfried Hermel, Octeville-sur-Mer (FR); Pierrick Protais, Octeville-sur-Mer (FR)

(73) Assignee: Sidel Participations, Octeville-sur-Mer (FR)

( * ) Notice: Subject to any disclaimer, the term of this patent is extended or adjusted under 35 U.S.C. 154(b) by 0 days.

(21) Appl. No.: 13/704,889

(22) PCT Filed: Jun. 15, 2011

(86) PCT No.: PCT/FR2011/051361
§ 371 (c)(1), (2), (4) Date: Dec. 17, 2012

(87) PCT Pub. No.: WO2011/157952
PCT Pub. Date: Dec. 22, 2011

(65) Prior Publication Data

US 2013/0087568 A1 Apr. 11, 2013

(30) Foreign Application Priority Data

Jun. 18, 2010 (FR) ..... 10 54869

(51) Int. Cl.
*B65D 1/42* (2006.01)
*B65D 1/02* (2006.01)

(52) U.S. Cl.
CPC ..... *B65D 1/42* (2013.01); *B65D 1/0284* (2013.01)
USPC ..... 215/376; 220/623; 220/628

(58) Field of Classification Search
CPC .. B65D 23/001; B65D 1/0284; B65D 1/0276; B65D 1/0261; B65D 1/0223
USPC ..... 215/376, 374, 373, 372, 371, 370; D9/540, 537, 530, 520
See application file for complete search history.

(56) References Cited

U.S. PATENT DOCUMENTS

| | | | | |
|---|---|---|---|---|
| 4,054,219 | A * | 10/1977 | Young et al. | 215/375 |
| 4,598,831 | A * | 7/1986 | Nakamura et al. | 215/373 |
| 4,978,015 | A * | 12/1990 | Walker | 215/375 |
| 5,005,716 | A * | 4/1991 | Eberle | 215/373 |
| 6,276,546 | B1 * | 8/2001 | Davis et al. | 215/375 |
| D617,647 | S | 6/2010 | Bledsoe | |
| 2009/0308835 | A1 | 12/2009 | Boukobza | |
| 2010/0285256 | A1 | 11/2010 | Boukobza | |

FOREIGN PATENT DOCUMENTS

| | | | |
|---|---|---|---|
| FR | 2 926 035 | A1 | 7/2009 |
| FR | 2 932 458 | A1 | 12/2009 |
| WO | 00/07886 | A1 | 2/2000 |

* cited by examiner

*Primary Examiner* — Robert J Hicks
(74) *Attorney, Agent, or Firm* — Sughrue Mion, PLLC

(57) ABSTRACT

A container made of thermoplastic material, including a body that extends between a neck and a base that is able to withstand, without significantly deforming, a hydrostatic pressure caused by the column of a liquid contained in the container, the column of liquid being increased by a pressure not exceeding $2\times10^5$ Pa. The base includes main ribs in the form of grooves that are open towards the outside and extend approximately radially, passing through an annular zone that forms an approximately flat seat by way of which the base can rest in a stable manner on a flat support. The main ribs extend upwards on a wall connecting the base to the body of the container. The container has a shoulder that forms a joining zone between the connecting wall and the body of the container, and the main ribs extend upwards beyond the shoulder.

15 Claims, 5 Drawing Sheets

LIGHTWEIGHT CONTAINER HAVING A REINFORCED BASE

CROSS REFERENCE TO RELATED APPLICATIONS

This application is a National Stage of International Application No. PCT/FR2011/051361, filed on Jun. 15, 2011, which claims priority from French Patent Application No. 1054869, filed on Jun. 18, 2010, the contents of all of which are incorporated herein by reference in their entirety.

The invention relates to improvements made to the bases of containers, particularly to the bases of bottles, of thermoplastic material such as PET, having a body extending between a neck at the upper end and a base at the lower end, able to withstand, without significant deformation, the hydrostatic pressure due to the column of liquid increased by a pressure not exceeding about $2\times10^5$ Pa.

Containers intended to contain a non-carbonated liquid (for example bottles intended to hold still water) are in most cases equipped with a domed base that is generally in the shape of a spherical end cap with an outwardly facing concavity of relatively small height.

Such bases generally have ribs which extend substantially radially and are distributed around a central reinforcement. These ribs can have various configurations and some may extend beyond the base of the wall of the body in order to reinforce the seat (peripheral area allowing the base to rest on a support).

The height of bases of this type, including the central reinforcement, is typically about 10 mm and may be as much as 15 mm. Such bases are designed to support the column of still liquid above them, without deformation.

However, they do not provide sufficient resistance to withstand additional stresses, for example due to extra pressure inside the bottle, even if the added pressure is slight.

It is therefore known, for containers in which the contents must undergo an inerting process, for example, to equip them with bases having improved resistance so that they do not deform when subjected to extra internal pressure.

Inerting is a process in which, after filling a container with liquid and before sealing it, the air remaining in the container is removed in order to better preserve the liquid.

A reinforced base of this type that is conventionally used is illustrated in FIGS. 1A to 1D of the attached drawings.

FIG. 1A is a side view of the lower portion of a container 1 (in this example a bottle that is substantially cylindrical) of a thermoplastic material such as PET, having a body 2 extending between a neck (not visible) at the upper end and a base 3 at the lower end.

The base 3 is represented by itself in FIG. 1B in a bottom view, in FIG. 1C in a diametrical cross-section along line IC-IC of FIG. 1B, and in FIG. 1D in a bottom perspective view.

The base 3 comprises a generally curved dome 4 with its concavity facing the outside of the container 1, and has an annular zone 5 surrounding the dome 4 and forming a substantially flat seat allowing said base 3 to rest in a stable manner on a flat support.

The central part of the dome 4 opens into a rounded bulge 6 which also has its concavity facing outwards, said bulge therefore being recessed within the container relative to the dome.

Outside the annular zone 5 forming a seat, the base 3 is connected to the body 2 of the container by a wall 8, called the connecting wall 8.

Several main ribs 7 which are open towards the outside, in the general form of grooves with substantially parallel edges and of a substantially constant depth, extend radially in a star arrangement from the wall 8 to the rounded bulge 6 where they end, passing through the annular zone 5 forming a seat and the dome 4. In the example illustrated, there is an odd number of main ribs 7, equal to five.

To improve the mechanical resistance of the base, secondary ribs 10 are added which may have substantially the same configuration as the main ribs 7. These secondary ribs are sandwiched between the main ribs 7 but extend radially in a star arrangement from the wall 8 to only the middle of the dome 4, passing through the annular zone 5 forming a seat.

It should be stressed that all the ribs, both main ribs 7 and secondary ribs 10, are formed as recesses in the dome 4, which has a smooth annular configuration that is notched only by the ribs, as can clearly be seen in FIGS. 1A to 1D.

Manufacturers of containers made of thermoplastic material such as PET are always looking for ways to achieve more lightweight containers, which means a more lightweight base for the containers. Due to this, the bases of containers having shapes considered satisfactory a few years ago are no longer appropriate because of the substantial decrease in the amount of material used.

Experience has shown that a reinforced base arranged as described above no longer provides satisfactory results in its lightweight version, even for positive pressures of only about $1\times10^5$ Pa.

To further reinforce the rigidity of the base of such a container, document FR 2 932 458 recommends creating claw-like areas on the dome 4, around the annular zone 5 forming the seat.

Document FR 2 932 458 also recommends varying the depth of the main ribs, with the depth being maximal approximately at the right angle with the annular zone 5 forming a seat.

The objective of the present invention is to propose a more advantageous implementation than what is recommended in document FR 2 932 458. It combines the effect of the ribs with a reinforcing effect from the base of the container.

Document FR 2 926 035 proposes bases of lightweight containers which comprise a shoulder between a first portion of the base of the bottle forming the seat and a second portion terminating the body of the container at its lower end (the part at the bottom when the container has its mouth oriented upwards).

Such a container base has the disadvantage of not preventing the swiveling phenomenon. This is the phenomenon where, when the container is placed on a flat surface, the axis of the container swings relative to the vertical axis (because of the low weight of the container) and the container rotates around a theoretical vertical axis while straightening its axis until it comes to a stop on its own when its axis aligns with the theoretical vertical axis.

The invention aims to overcome this disadvantage as well.

For this purpose, it relates to a container made of thermoplastic material, comprising a body connected to a base able to withstand, without noticeable deformation, a hydrostatic pressure caused by the column of a liquid contained in said container, the column of liquid being increased by a pressure not exceeding $2\times10^5$ Pa, the base comprising main ribs in the form of grooves that are open towards the outside and extend substantially radially through an annular zone forming a substantially flat seat allowing said base to rest in a stable manner on a flat support, the main ribs being distributed in a star arrangement and extending up a wall connecting the base to the body of the container. The container of the invention is noteworthy in that it comprises a shoulder forming a connecting area between the connecting wall and the body of the container, and in that said main ribs extend upwards beyond said shoulder on the connecting wall.

The combination of the shoulder and the radial ribs which cross said shoulder improves the rigidity at the base of the container and alleviates the swiveling problem described above.

The shoulder contributes to reinforcing the effect of the vertical ribs that cross it, as the vertical ribs counteract against the phenomenon where the base of the container is crushed by the weight of the liquid it contains, and the shoulder prevents any vertical bellows-like motion of the container base. In addition, the extended ribs in their star arrangement on the base prevent the swiveling phenomenon, and their "anti-swiveling" effect is also reinforced by the fact that they cross the shoulder.

The invention may also comprise the following characteristics, separately or in combination:

- the base may comprise:
  - a concave dome with its concavity facing towards the outside of the container, and
  - an inward bulge in the container, its concavity facing towards the outside, opening at the center of the dome,
  - the main ribs extending radially on the dome from the seat to the bulge.
- the base may also comprise secondary ribs which are radial and are sandwiched between the main ribs, and which extend radially in a star arrangement on the connecting wall and across the seat all the way to approximately the beginning of the dome;
- the secondary ribs can extend across the connecting wall and beyond the shoulder, to a level substantially identical to that of the main ribs;
- in a first embodiment, the base may comprise a number of uniformly distributed main ribs and the same number of uniformly distributed secondary ribs each sandwiched between two adjacent main ribs;
- in a second embodiment, the base may comprise between six to twelve uniformly distributed main ribs and between six to twelve secondary ribs each sandwiched between two main ribs;
- in yet another variant, the base may comprise a number of uniformly distributed main ribs and a same number of identical uniformly distributed sets of multiple secondary ribs each sandwiched between two adjacent main ribs;
- in the case of that last embodiment, the base can be arranged to have four uniformly distributed main ribs and four sets of three secondary ribs with each set sandwiched between two consecutive main ribs;
- in another variant, the base can be arranged to have five uniformly distributed main ribs and five sets of two secondary ribs with each set sandwiched between two consecutive main ribs;
- in an embodiment which will be described and illustrated below, the secondary ribs may have a regular depth on the connecting wall, between the seat and the shoulder;
- in addition, the main ribs may have a depth which decreases between the seat and the shoulder;
- the main ribs may also have a regular depth across the dome;
- in addition, said main ribs may have, in the vicinity of the central bulge, a flaring end such that a flaring end of one main rib meets a flaring end of an adjacent main rib, with the flaring ends forming a sunburst pattern around the bulge;
- in addition, the main ribs may flare in a regular arrangement on the dome, from the seat to the vicinity of the bulge;
- the "anti-swiveling" effects have been observed for the embodiments in which the main ribs extend beyond the shoulder and onto the body of the container, to a height of substantially between 1 and 5 mm, and preferably between 1 and 2 mm;
- in advantageous embodiments, the container can have a container capacity that is substantially 0.5 L and a weight that is substantially 7 g.

The invention is detailed in a sufficiently clear and complete manner in the following description to enable its execution. This description is accompanied by drawings in which:

FIG. 1A is a side view of the lower portion of a container (here a generally cylindrical bottle) of thermoplastic material such as PET, according to the prior art;

FIGS. 1B to 1D respectively show a bottom view, a diametrical cross-section along line IC-IC of FIG. 1B, and a perspective bottom view, of only the base of the container shown in FIG. 1A;

Figure 7:
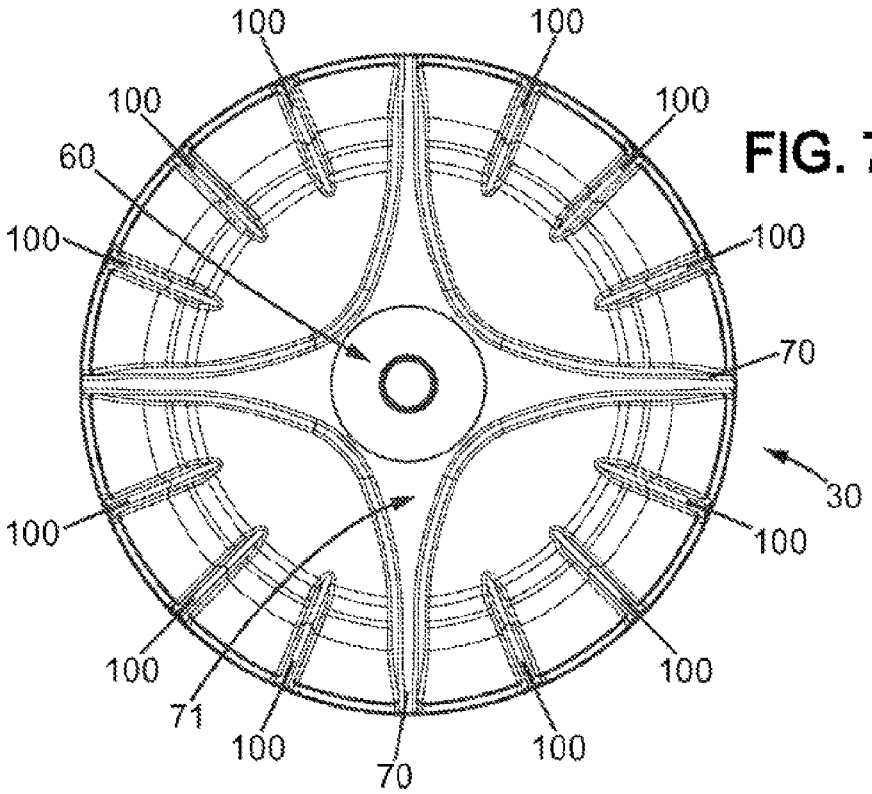
Figure 8:
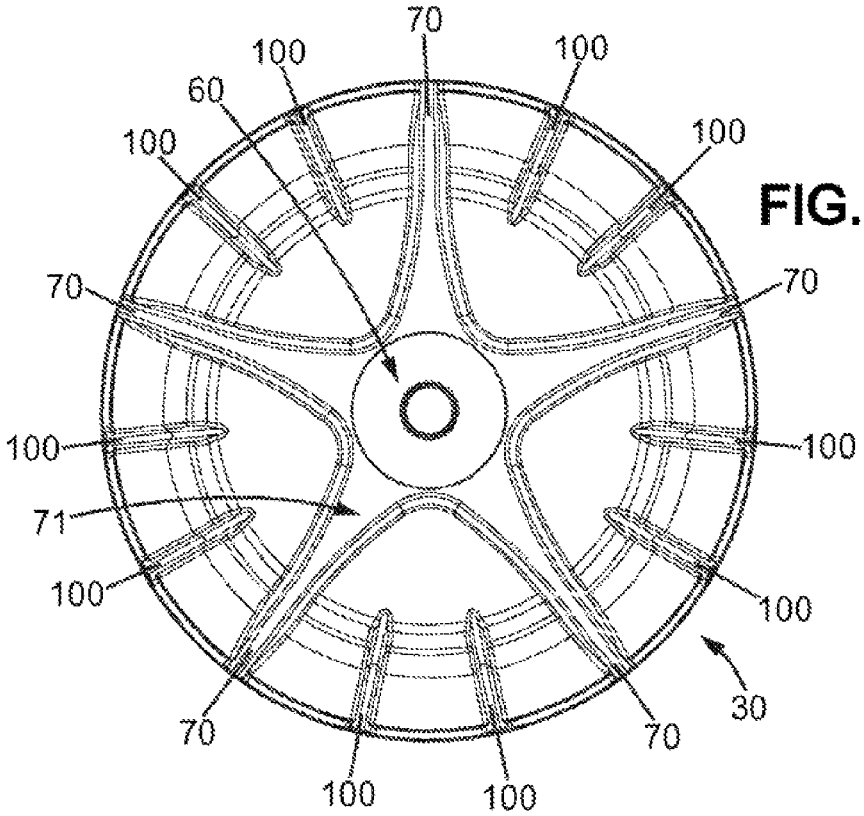

FIGS. 7 and 8 schematically illustrate a bottom view of two variants of a base of a container according to the invention.

In the following description, the terms "lower", "upper", "top", "bottom", etc., are used with reference to the drawings for ease of understanding. They are not to be taken as limitations to the scope of the invention.

FIGS. 2 to 6 will now be referred to while describing a preferred embodiment of the invention. FIGS. 1A to 1D represent a base of a container according to the prior art.

Figure 2:
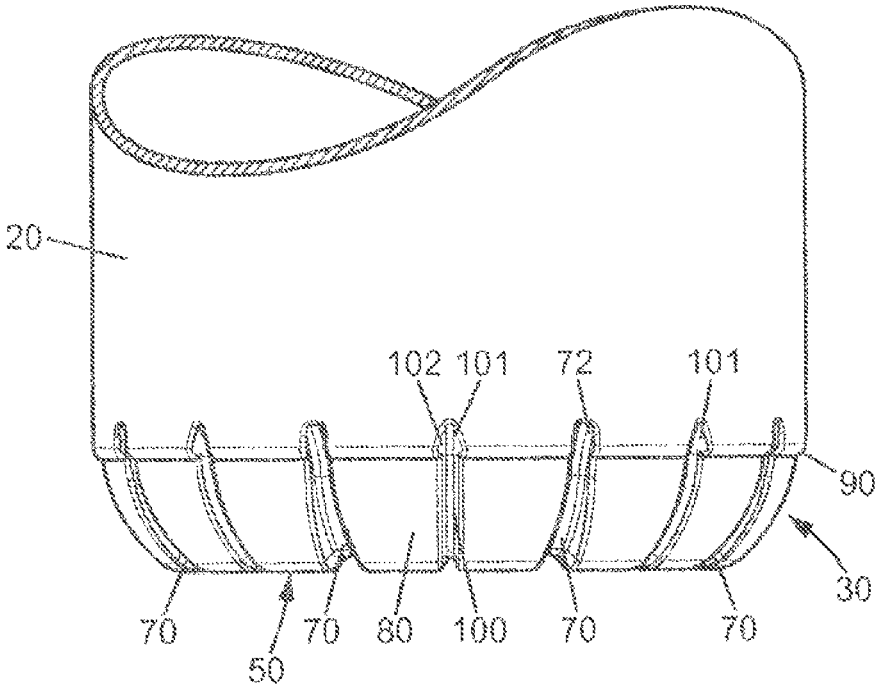
FIG. 2 illustrates a base of a container of the invention, viewed from the side.

FIG. 2 shows a base 30 of a container according to the invention.

Figure 3:
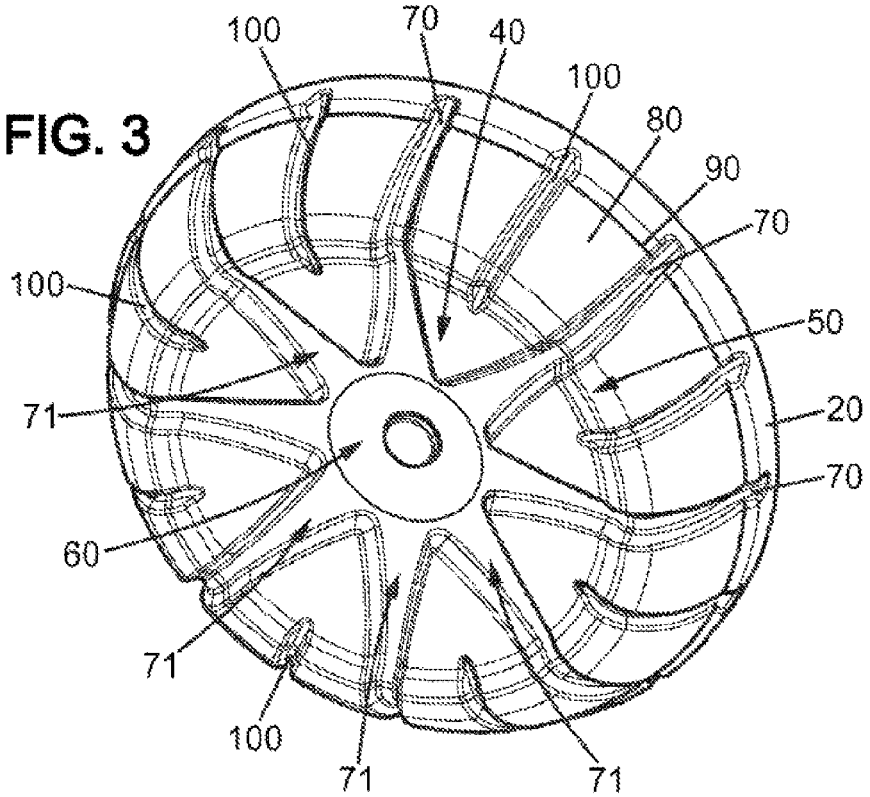
FIG. 3 shows the base of FIG. 2 in a bottom perspective view.
Figure 4:
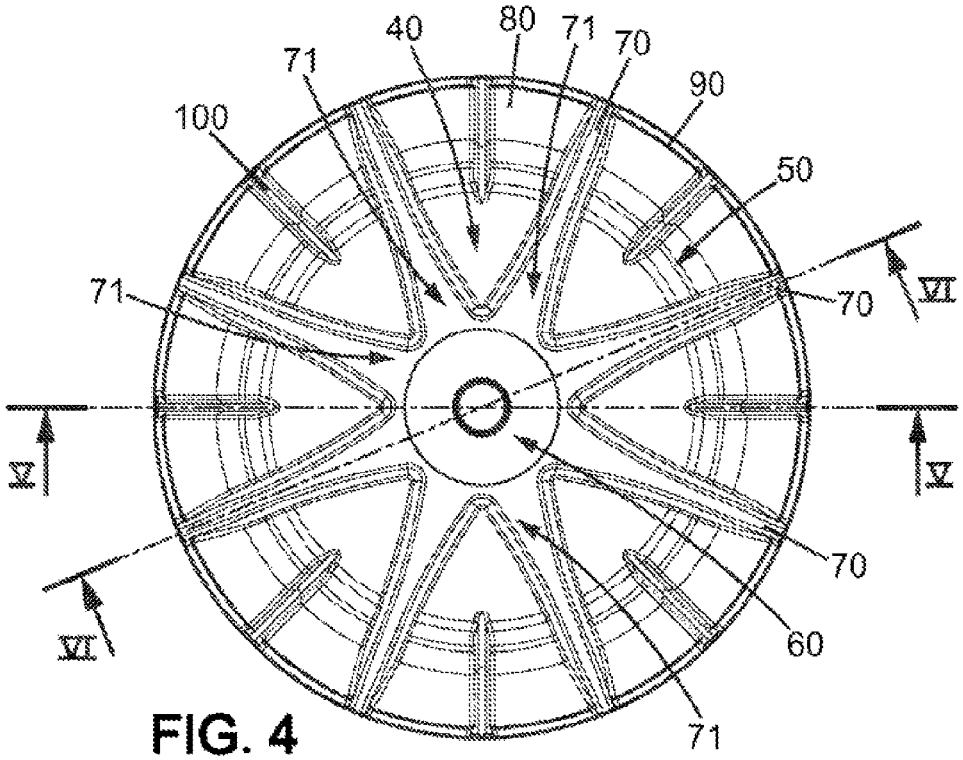
FIG. 4 is a bottom view of the base illustrated in FIG. 2.

The base 30 is also represented in FIGS. 3 and 4, in a bottom view.

The base 30 can be obtained by molding, as is known to a person skilled in the art.

The base 30 comprises ribs 70, referred to as main ribs 70, each in the form of a groove opening towards the outside, extending in a substantially radial direction and passing through an annular zone forming a substantially flat seat 50 allowing the base to rest in a stable manner on a flat support.

The main ribs 70 extend up a wall 80 which ensures the connection of the base 30 to the body 20 of the container (see FIG. 2).

Figure 1A:
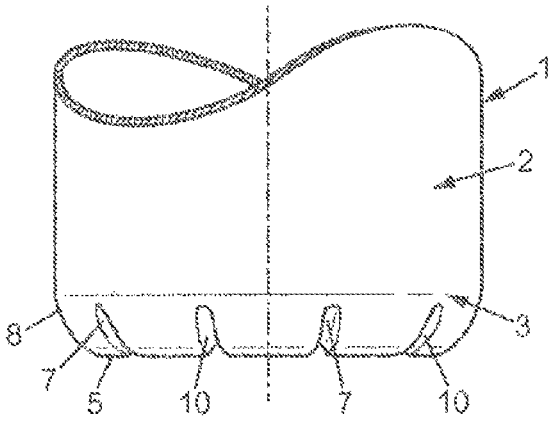
FIG. 1A (RELATED ART)
Figure 1B:
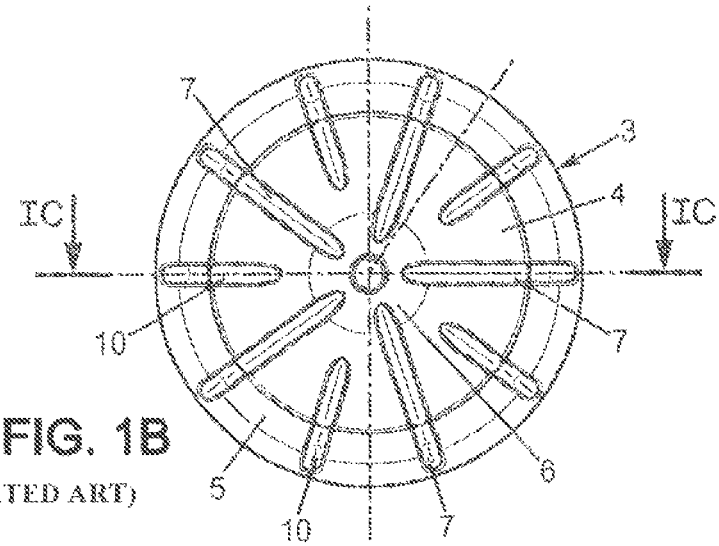
FIG. 1B (RELATED ART)
Figure 1C:
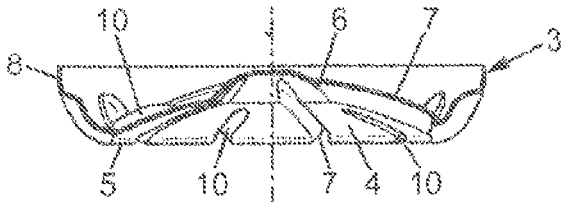
FIG. 1C (RELATED ART)
Figure 1D:
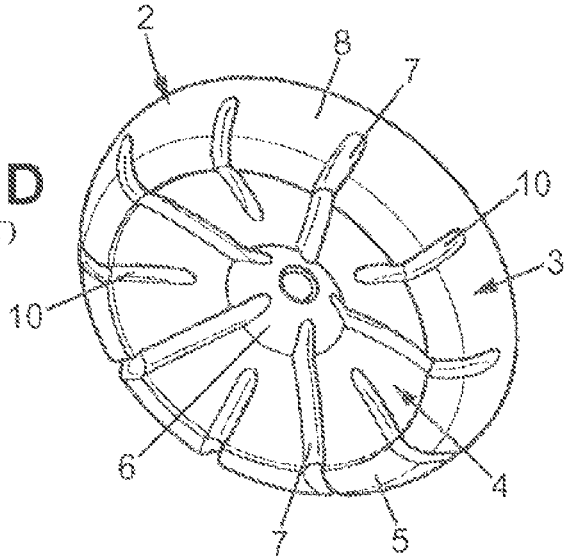
FIG. 1D (RELATED ART)

One can also see in FIGS. 3 and 4 that the base comprises, in a known manner, a concave dome 40 with its concavity facing the outside of the container (like the dome 4 illustrated in FIGS. 10 and 1D for the container of the prior art).

The base 30 of the container of the invention also comprises a bulge 60 projecting inwards into the container and with its concavity facing outwards, formed at the center of the dome 40.

One will note in particular in FIGS. 3 and 4 that the main ribs 70 extend radially on the dome 40, from the seat 50 to the bulge 60.

In the lateral part of the base 30 of the container according to the invention, the main ribs 70 extend up the connecting wall 80 to the body 20 of the container and across a shoulder 90 created along the periphery of the container.

In other words, the main ribs 70 extend up beyond said shoulder 90 created on the periphery of the container.

The shoulder 90 forms a connecting area between the connecting wall 80 and the body 20 of the container.

The shoulder 90 is created by an abrupt change in diameter between the connecting wall 80 and the body 20 of the container.

This abrupt change in diameter can be achieved by a steep slope connecting the connecting wall 80 and the body 20 of the container.

The connection between the wall 80 and the shoulder 90, and the connection between the shoulder 90 and the body 20, are established as angle edges.

Thus the shoulder 90 prevents a deformation of the base of the container, for example the base splaying out due to the weight of the column of liquid contained in the container. It also prevents any accordion-type action of the base of the container relative to the body 20 of the container.

Thus the shoulder 90 is a reinforcement which prevents the deformation of the base.

The main ribs 70 have a particular profile, as can be seen in FIGS. 3 and 4.

In particular, the main ribs 70 have a width which steadily increases between the seat 50 and the bulge 60. In other words, the main ribs 70 gradually and regularly flare out across the dome 40 defined between the seat 50 and the bulge 60.

One can see in particular that the end 71, located near the bulge 60, of each main rib 70 is sufficiently flared for the flared end 71 of one main rib 70 to meet the flared end 71 of an adjacent main rib 70.

The flared ends 71 thus form a sunburst pattern around the bulge 60. The sunburst pattern of the ribs 70 around the bulge contributes to limiting the swiveling effect defined above. In addition, the anti-swiveling effect of the sunburst pattern is increased when it is combined with the fact that the main ribs 70 extend across the shoulder 90.

As can be seen in the figures, in this embodiment of the base of the container according to the invention, the base 30 also comprises secondary ribs 100 which are radial and sandwiched between said main ribs 70, and which also extend radially in a star arrangement on the connecting wall 80 and pass across the seat 50 substantially to the beginning of the dome 40.

"Beginning of the dome" is understood to mean the part of the dome 40 which is connected to the seat 50.

The secondary ribs 100 extend across the connecting wall 80, and also extend beyond said shoulder 90 to a level substantially identical to that of the main ribs 70.

In the example illustrated, the base 30 comprises a number of uniformly distributed main ribs 70 and the same number of uniformly distributed secondary ribs 100 each sandwiched between two adjacent main ribs 70.

In the embodiment illustrated in FIGS. 2 to 6, the base 30 comprises eight main ribs 70 alternating with eight secondary ribs 100.

In general, the container of the invention could comprise between six to twelve main ribs 70 distributed uniformly on its base 30, and as many secondary ribs 100 each sandwiched between two adjacent main ribs 70.

It is understood that the invention is not limited to such embodiments, however.

In fact, as illustrated schematically in a bottom view in FIGS. 7 and 8, the base 30 can comprise different arrangements of the main ribs 70 and secondary ribs 100. The base 30 could comprise a number of uniformly distributed main ribs 70 and a same number of identical sets of multiple uniformly distributed secondary ribs 100, each set sandwiched between two adjacent main ribs 70. In one embodiment, illustrated in FIG. 7, with four main ribs 70 distributed uniformly on the base 30, there can be for example four identical sets of three secondary ribs 100, each set sandwiched between two consecutive main ribs 70.

In a variant illustrated in FIG. 8, the base could comprise five main ribs 70 distributed uniformly on the base 30, and five sets of two secondary ribs sandwiched between two consecutive main ribs 70, without leaving the scope of the invention.

In the context of the illustrated embodiment, the base 30 is intended for a container which can contain approximately 0.5 liters and has a weight of approximately 7 grams.

In the context of this embodiment, the main ribs 70 and secondary ribs 100 again extend beyond the shoulder 90 onto the body 20 to a height that is substantially between 1 and 5 mm and preferably between 1 and 2 mm. It is with these dimensions that the swiveling effect is reduced the most when the embodiment is applied to a container designed to hold such amounts.

Now the profile of the main ribs 70 and the secondary ribs 100 in the base 30 will be described, with reference to FIGS. 5 and 6.

Figure 5:
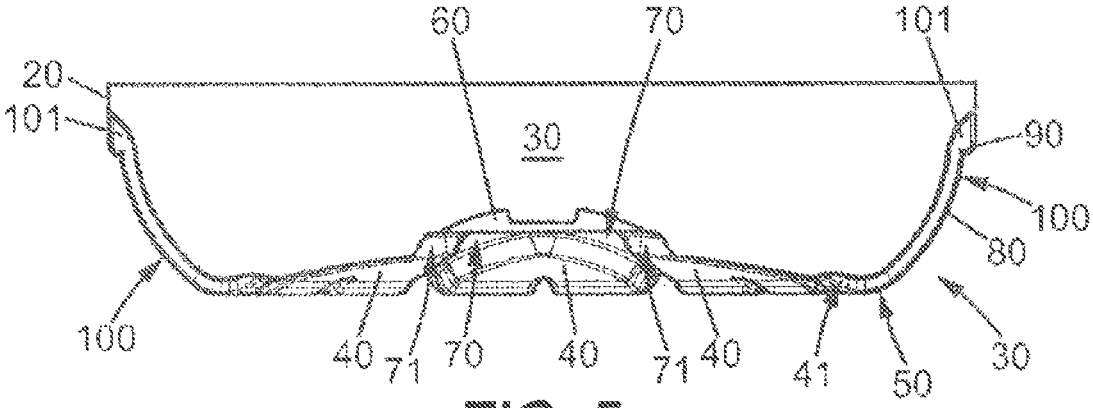
FIG. 5 is a cross-sectional view along the plane V-V shown in FIG. 4.

FIG. 5 shows a cross-sectional view of the secondary ribs 100. One can see that the secondary ribs 100 extend over the wall 80, ensuring the connection between said base 30 and the body 20 of the container.

One can also see that the secondary ribs 100 run across the seat 50 to the beginning 41 of the dome 40, meaning the part of the dome 40 which is located near the seat 50.

The secondary ribs 100 have a regular depth between the seat 50 and the shoulder 90.

Beyond the shoulder 90, therefore in their part closest to the body 20 of the container, the secondary ribs 100 have an end 101 in which the depth decreases.

In FIGS. 2 and 3, note that the end 101 of the secondary rib 100 has a width which is first increasing (greatest width labeled 102) starting at the shoulder 90, then decreasing, forming an arrowhead-like shape pointing towards the top of the container.

Figure 6:
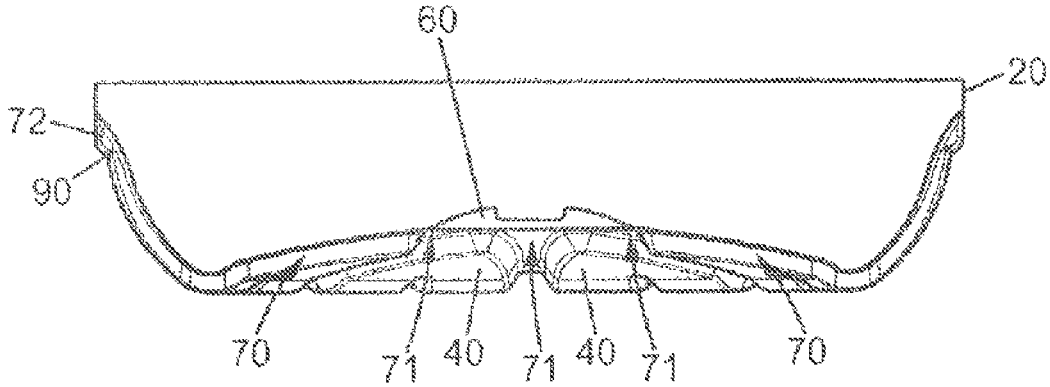
FIG. 6 is a cross-sectional view along the plane VI-VI shown in FIG. 4.

The main ribs 70 are represented in FIG. 6. Their depth decreases between the seat 50 and the shoulder 90.

The end 72 of each main rib 70, which is located above the shoulder 90 and is therefore the one closest to the body 20 of the container, has a form substantially identical to that of the end 101 of the secondary ribs 100 which were described above, as is particularly visible in FIGS. 2 and 3.

The main ribs 70 also have a regular depth (i.e., a constant depth) on the dome 40, as is shown in FIG. 6.

Also note that flaring end 71 of the main ribs 70 ends substantially at the foot of the bulge 60.

The main ribs 70 therefore do not encroach into the bulge 60, unlike the encroachment of the main ribs 70 into the bulge 60 known in the prior art and shown in FIG. 1D.

In this manner, the main ribs 70, due to their specific shape and the fact that they extend across the shoulder 90, prevent the swiveling effect of the base when the base of the container is placed on a flat surface for example.

The above description clearly explains how the ribs and the shoulder of the invention are implemented, in order to prevent any swiveling phenomenon and also to reinforce the base of a particularly lightweight container, since such a container may have a weight of about seven grams.

However, it should be understood that the invention is not specifically limited to the embodiments which have been presented.

The invention extends to the implementation of any equivalent means.

The invention claimed is:

1. Container made of thermoplastic material, comprising a body connected to a base able to withstand, without noticeable deformation, a hydrostatic pressure caused by a column of liquid contained in said container, said column of liquid being increased by a pressure not exceeding $2\times10^5$ Pa, said base comprising main ribs in the form of grooves that are open towards the outside and extend substantially radially through an annular zone forming a substantially flat seat allowing said base to rest in a stable manner on a flat support, said main ribs being distributed in a star arrangement on the base and extending up a wall connecting the base to the body of the container, said container comprising a shoulder forming a connecting area between said connecting wall and the body of the container, wherein said main ribs extend upwards beyond said shoulder on the connecting wall, wherein said main ribs have a constant depth across a dome.

2. Container according to claim 1, wherein said base comprises:

a concave dome with its concavity facing towards the outside of the container, and an inward bulge in the container, its concavity facing towards the outside, opening at the center of said dome, said main ribs extending radially on said dome from the seat to the bulge.

3. Container according to claim 2, wherein said base comprises secondary ribs which are radial and are sandwiched between said main ribs, and which extend radially in a star arrangement on the connecting wall and across the seat to approximately the beginning of the dome.

4. Container according to claim 3, wherein said secondary ribs extend across said connecting wall and beyond said shoulder, to a level substantially identical to that of said main ribs.

5. Container according to claim 3, wherein the base comprises a number of said main ribs, which are uniformly distributed, and a same number of said secondary ribs, which are uniformly distributed, and which are each sandwiched between two adjacent main ribs.

6. Container according to claim 5, wherein the base comprises between six to twelve uniformly distributed main ribs and between six to twelve secondary ribs each sandwiched between two main ribs.

7. Container according to claim 3, wherein the base comprises a number of said main ribs, which are uniformly distributed, and a same number of identical uniformly distributed sets of said secondary ribs each sandwiched between two adjacent main ribs.

8. Container according to claim 7, wherein the base comprises four uniformly distributed main ribs and four sets of three secondary ribs with each set sandwiched between two consecutive main ribs.

9. Container according to claim 7, wherein the base comprises five uniformly distributed main ribs and five sets of two secondary ribs with each set sandwiched between two consecutive main ribs.

10. Container according to claim 3, wherein the secondary ribs have a regular depth on the connecting wall, between the seat and the shoulder.

11. Container according to claim 3, wherein said main ribs have a depth which decreases between the seat and the shoulder.

12. Container according to claim 2, wherein each of said main ribs has, in the vicinity of the bulge, a flaring end such that a flaring end of each respective main rib meets a flaring end of an adjacent main rib, with the flaring ends forming a sunburst pattern around the bulge.

13. Container according to claim 12, wherein the main ribs flare out in a regular arrangement on the dome, from the seat to the vicinity of the bulge.

14. Container according to claim 1, wherein said main ribs extend beyond said shoulder onto the body of the container, to a height of substantially between 1 and 5 mm.

15. Container according to claim 1, said container comprising a container capacity which is 0.5 L and comprising a weight which is substantially 7 g.

* * * * *